US011879716B2

(12) United States Patent
Kruger et al.

(10) Patent No.: US 11,879,716 B2
(45) Date of Patent: Jan. 23, 2024

(54) METHOD OF VALIDATING A SHOCK TUBE EVENT

(71) Applicant: DETNET SOUTH AFRICA (PTY) LTD, Johannesburg (ZA)

(72) Inventors: Michiel Jacobus Kruger, Johannesburg (ZA); Christopher Malcolm Birkin, Centurion (ZA); Richard Joseph Michna, Barkhamsted, CT (US); Daniel Auguste Maurissens, Orbe (CH); Andre Louis Koekemoer, Boksburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 402 days.

(21) Appl. No.: 17/422,655

(22) PCT Filed: Jan. 27, 2020

(86) PCT No.: PCT/ZA2020/050010
§ 371 (c)(1),
(2) Date: Jul. 13, 2021

(87) PCT Pub. No.: WO2020/160576
PCT Pub. Date: Aug. 6, 2020

(65) Prior Publication Data

US 2022/0082362 A1 Mar. 17, 2022

(30) Foreign Application Priority Data

Jan. 28, 2019 (ZA) ..... 2019/00558

(51) Int. Cl.
*F42C 7/00* (2006.01)
*F42C 13/02* (2006.01)
*F42D 1/04* (2006.01)

(52) U.S. Cl.
CPC ..... *F42C 7/00* (2013.01); *F42C 13/02* (2013.01); *F42D 1/043* (2013.01)

(58) Field of Classification Search
CPC ..... F42C 7/00; F42C 13/02; F42D 1/043
(Continued)

(56) References Cited

U.S. PATENT DOCUMENTS 8,967,048 B2 * 3/2015 Harding ..... F42D 1/042 102/206
2012/0012019 A1 * 1/2012 Harding ..... F42D 1/05 368/9
2017/0322005 A1 * 11/2017 Labuschagne ..... F42D 1/05

FOREIGN PATENT DOCUMENTS

WO 2011044593 A1 4/2011
WO WO-2018094426 A1 * 5/2018 ..... C06C 5/04
(Continued)

OTHER PUBLICATIONS

International Preliminary Report on Patentability for PCT/ZA2020/050010, international filing date of Jan. 27, 2020, date of completion Apr. 7, 2021, 11 pages.
(Continued)

*Primary Examiner* — Samir Abdosh
(74) *Attorney, Agent, or Firm* — CANTOR COLBURN LLP

(57) ABSTRACT

A detonator which is responsive to a shock tube event which is validated if a link is fused at a predetermined time interval after a light signal produced by the event is detected and if, at the end of a subsequent time interval, the link is still fused and the light signal is absent.

16 Claims, 2 Drawing Sheets

(58) Field of Classification Search
USPC ..... 102/201
See application file for complete search history.

(56) References Cited

FOREIGN PATENT DOCUMENTS

| | | | | |
|---|---|---|---|---|
| WO | WO-2020160573 A1 * | 8/2020 | ..... | F42C 15/36 |
| WO | WO-2020160576 A1 * | 8/2020 | ..... | F42C 13/02 |
| WO | WO-2020160578 A1 * | 8/2020 | ..... | F42D 1/043 |

OTHER PUBLICATIONS

International Search Report for PCT/ZA2020/050010, international filing date of Jan. 27, 2020, dated Apr. 30, 2020, 3 pages.
Written Opinion for PCT/ZA2020/050010, international filing date of Jan. 27, 2020, dated Apr. 30, 2020, 6 pages.

* cited by examiner

METHOD OF VALIDATING A SHOCK TUBE EVENT

CROSS-REFERENCE TO RELATED APPLICATIONS

This application is a U.S. national stage application of International Application No. PCT/ZA2020/050010 entitled "METHOD OF VALIDATING A SHOCK TUBE EVENT", which has an international filing date of 27 Jan. 2020, and which claims priority to South African Patent Application No. 2019/00558, filed 28 Jan. 2019.

BACKGROUND OF THE INVENTION

This invention relates to a detonator which is initiated by a shock tube and to a method of validating a shock tube event. This type of arrangement is described for example in the specification of U.S. Pat. No. 8,967,048.

To prevent inadvertent firing of the detonator those characteristics which are uniquely associated with a shock tube event and which are used to initiate a detonator firing process must be validated. For example, if a light signal associated with a shock tube event is to be detected, then a technique must be adopted to ensure that a light signal, produced by an extraneous source, is not mistaken to be a light signal associated with the shock tube event.

The invention is concerned with a detonator which addresses the aforementioned requirement.

SUMMARY OF THE INVENTION

The invention provides a detonator which is configured to be connected to an end of a shock tube which, upon ignition, generates a shock tube event at an end of the shock tube, the detonator including at least a first sensor and a second sensor, a processor and a timer, wherein the first sensor upon detecting a first characteristic associated with a shock tube event transmits a first signal at a time $T_0$ to the processor which via the timer initiates a timing schedule in which:

(a) at a time $T_1$, which is at an end of a first predetermined time interval ($P_1$) commencing at the time $T_0$, the processor determines whether the first sensor detects the first characteristic at the time $T_1$, (b) at a chosen time after $T_0$ it is established whether prior to $T_0$ the second sensor had detected a reference characteristic of a shock tube event, (c) after a time $T_3$ at which time the first characteristic, if produced by a genuine shock tube event, is absent, the processor determines whether the second sensor has sensed a second characteristic of the shock tube event, and (d) wherein the shock tube event is validated if the second sensor has sensed such second characteristic.

Preferably such chosen time is time $T_1$ and said reference characteristic is the second characteristic.

The first characteristic may be a light signal associated with a genuine shock tube event. The first sensor may then be a light sensor. The second characteristic may be a pressure wave which is associated with the shock tube event and the second sensor may be a fusible link which in response to the pressure wave is fused, i.e. rendered open-circuit. The sensors and characteristics are exemplary only and are non-limiting.

Preferably at a time $T_2$, which is at the end of a second predetermined time interval ($P_2$) commencing at the time $T_0$ and after the time $T_3$, the processor determines via the first sensor, whether the first characteristic is present, and the processor determines whether the second sensor has sensed the second characteristic.

Additional sensors which are responsive to additional or similar characteristics may be used in the detonator. The invention is not limited in that respect.

BRIEF DESCRIPTION OF THE DRAWINGS

The invention is further described by way of example with reference to the accompanying drawings in which.

DESCRIPTION OF PREFERRED EMBODIMENT

Figure 1:
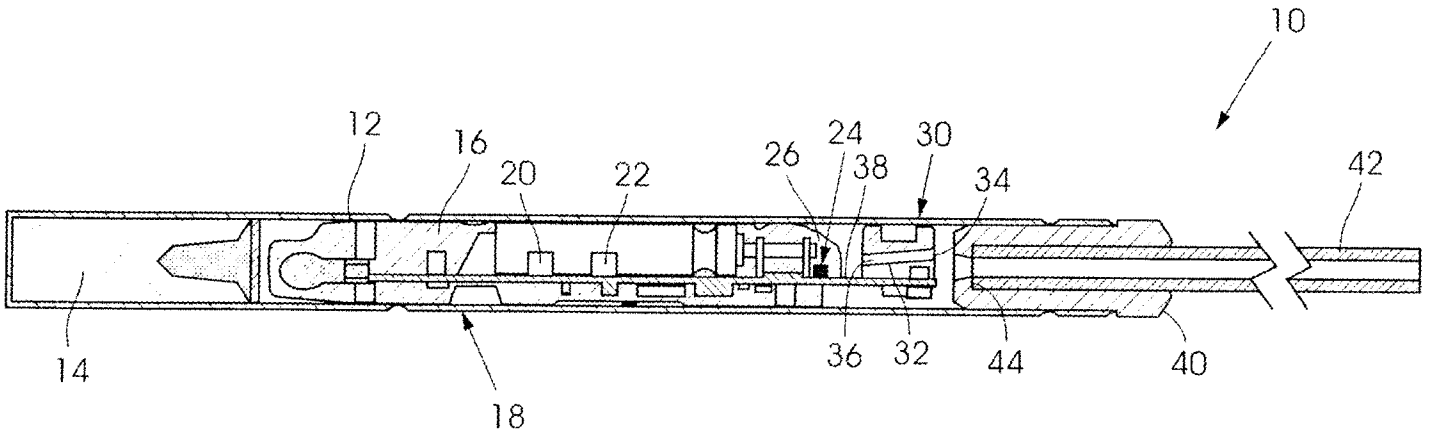
FIG. 1 illustrates schematically components of a detonator according to the invention connected to an end of a shock tube.

FIG. 1 of the accompanying drawings illustrates components of a detonator 10 according to the invention.

The detonator 10 includes a tube 12 which houses a base charge 14 at one end of the tube. Adjacent and slightly spaced from the base charge 14 is an electronic module 16. An understanding of the full nature of the module 16 is not necessary for the purposes of this specification. The module 16 includes various electronic components collectively designated with the reference numeral 18, a processor 20 and a timer 22. A first sensor which in this example is a light sensor 24 is encased in a protective transparent plastics housing 26 at one end of the module 16. Also located at this end is a housing 30. A passage 32 extends through the housing 30. The passage is tapered so that it is of reducing cross sectional area from an inlet 34 to an outlet 36. At least one second sensor, in this instance a fusible link 38, is mounted to span an interior of the passage 32 at or close to the outlet 36. The fusible link 38 may be one of a number of fusible links. It is also possible to replace the fusible link 38 with a plasma pad sensor or any other sensor which is responsive in a unique, repetitive and reliable manner to a chosen characteristic in a shock tube event.

The tube 12 is configured so that an open end 40 thereof can be connected to a shock tube 42 with an end 44 of the shock tube facing the inlet 34 to the passage 32.

When the shock tube 42 is fired a shock tube event is generated at the end 44. The expression "shock tube event" is used in a generic sense to designate a complex process in which a pressure wave is emitted by the shock tube 42. The pressure wave is accompanied by the emission of plasma and light. There is also a temperature rise associated with the shock tube event. Other characteristics uniquely related to the shock tube event are not referred to herein.

Figure 2:
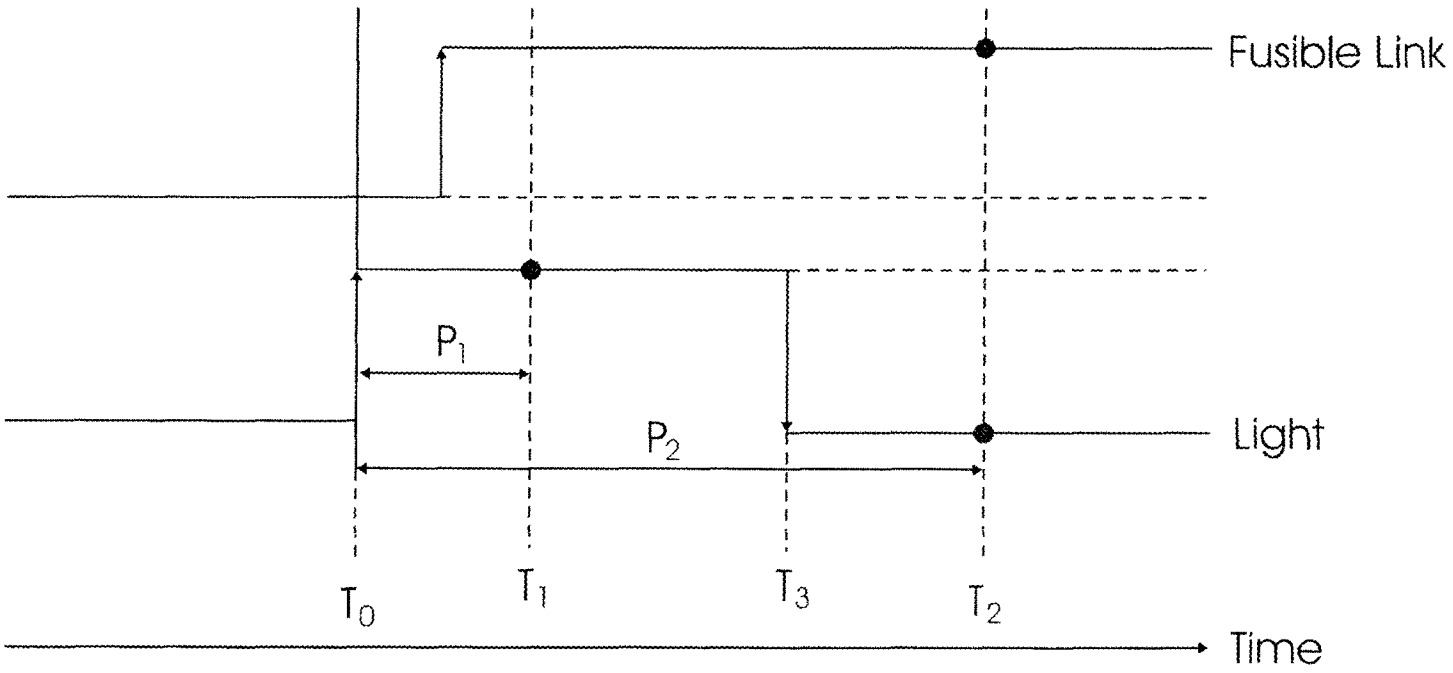
FIG. 2 shows a series of time events used in the validation process of the invention.

When light from the shock tube event is detected by the light sensor 24, this is regarded as a trigger factor which occurs at time $T_0$ (see FIG. 2). A signal is sent by the light sensor 24 to the processor 20 which, via the timer 22, initiates a timing schedule which is shown in FIG. 2.

At a time $T_1$, which is at an end of a time period $P_1$ of predetermined duration, commencing at the time $T_0$, the processor 20 establishes whether the light sensor 24 detects the presence of light. In this respect it is to be noted that a light pulse produced by a shock tube event, although of extremely short duration, is not instantaneous. The duration of the period $P_1$ is of the order of microseconds.

At a time $T_2$ which is at an end of a time period $P_2$ which is of predetermined duration, taken from the time $T_0$, the processor 20 by monitoring the status of, or by means of signals from, the fusible link 38 and the light sensor 24, determines whether the fusible link 38 is in a fused state or not, and whether the light sensor 24 detects light.

If a genuine shock tube event has occurred then, at the time $T_2$, due to pressure and temperature effects, the fusible link 38, which is fully exposed to the end 44 of the shock tube 42 which emits the shock tube event, ought to have been fused and, typically, would have been fully vaporized. If the fusible link 38 is in a series-connected circuit of any appropriate kind then the fusing of the link 38 establishes an open-circuit condition which is readily detected.

At the time $T_2$ the processor 20 thus determines whether the link 38 is in a fused state or not. The duration of the time interval $P_2$ is such that at the end thereof (i.e. at the time $T_2$) there is no likelihood that light emitted by a genuine shock tube event would still be present.

Figure 1A:
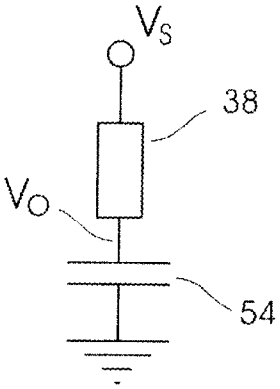
FIG. 1A shows a circuit for detecting a shock tube event.

A further safety feature is to check that prior to $T_0$ the fusible link 38 was intact. This is done in the way shown in FIG. 1A by using a supply voltage $V_s$ to charge a reference capacitor 54 through the fusible link 38. A voltage $V_0$ across the capacitor is monitored. If at time $T_0$ the voltage $V_0$ is less than a designed level it is taken that the link 38 has been fused. At a time $T_1$, or at any other chosen time after $T_0$, the test is for the presence of the light signal and whether, prior to $T_0$, the fusible link 38 was intact.

The signals which are detected in the aforementioned manner by the sensors and evaluated by the processor are taken to be indicative of a genuine shock tube event provided that the following states or events are confirmed:

(a) the light signal was detected at the time $T_1$;

(b) the fusible link 38 is in a fused state at the time $T_2$;

(c) the light signal is absent at the time $T_2$, and (d) the fusible link 38 was intact prior to $T_0$.

The invention has been described with reference to the use of a fusible link to detect a characteristic of a shock tube event. As an alternative to the use of the fusible link a plasma sensor can be employed.

Under the aforementioned conditions the processor 20 conducts further protocols to cause initiation of the detonator 10 and firing of the base charge 14. This aspect is not important to an understanding of the invention.

It is convenient to monitor the status of the fusible link 38 and the presence or absence of the light signal at the same time $T_2$. This however is not essential for the status of the fusible link 38 can be determined at a time which is different from the time at which the presence or absence of the light signal is sensed. Each detection should however be after a time $T_3$ (see FIG. 2) at which the light signal from a genuine shock tube event would be absent.

The invention claimed is:

1. A detonator which is configured to be connected to an end of a shock tube which, upon ignition, generates a shock tube event at an end of the shock tube, the detonator including at least a first sensor and a second sensor, a processor and a timer, wherein the first sensor upon detecting a first characteristic associated with a shock tube event transmits a first signal at a time $T_0$ to the processor which via the timer initiates a timing schedule in which:

(a) at a time $T_1$, which is at an end of a first predetermined time interval ($P_1$) commencing at the time $T_0$, the processor determines whether the first sensor detects the first characteristic at the time $T_1$, (b) at a chosen time after $T_0$ it is established whether prior to $T_0$ the second sensor had detected a reference characteristic of a shock tube event, (c) after a time $T_3$ at which time the first characteristic, if produced by a genuine shock tube event, is absent, the processor determines whether the second sensor has sensed a second characteristic of the shock tube event, and (d) wherein the shock tube event is validated if the second sensor has sensed such second characteristic.

2. A detonator according to claim 1 wherein such chosen time is time $T_1$ and said reference characteristic is the second characteristic.

3. A detonator according to claim 1 wherein the first characteristic is a light signal associated with a genuine shock tube event.

4. A detonator according to claim 1 wherein the first sensor is a light sensor.

5. A detonator according to claim 1 wherein the second characteristic is a pressure wave which is associated with the shock tube event.

6. A detonator according to claim 5 wherein the second sensor is a fusible link which, in response to the pressure wave, is fused.

7. A detonator according to claim 5 wherein the second sensor is a plasma sensor which is responsive to a shock tube event.

8. A detonator according to claim 1, wherein at a time $T_2$, which is at the end of a second predetermined time interval ($P_2$) commencing at the time $T_0$ and after the time $T_3$, the processor determines via the first sensor, whether the first characteristic is present, and the processor determines whether the second sensor has sensed the second characteristic.

9. A detonator according to claim 2 wherein the second characteristic is a pressure wave which is associated with the shock tube event.

10. A method of operating a detonator which is configured to be connected to an end of a shock tube which, upon ignition, generates a shock tube event at an end of the shock tube, the detonator including at least a first sensor, a second sensor, a processor and a timer, wherein the first sensor upon detecting a first characteristic associated with a shock tube event transmits a first signal at a time $T_0$ to the processor which via the timer initiates a timing schedule, and wherein the method includes the following steps:

(a) at a time $T_1$, which is at an end of a first predetermined time interval ($P_1$) commencing at the time $T_0$, determining whether the first sensor detects the first characteristic, (b) at a chosen time after $T_0$, establishing whether prior to $T_0$, the second sensor had detected a reference characteristic of a shock tube event, (c) after a time $T_3$, at which time the first characteristic, if produced by a genuine shock tube event, is absent, determining whether the second sensor sensed a second characteristic of the shock tube event, (d) at a time $T_2$, which is at an end of a second predetermined time interval ($P_2$) commencing at the time $T_0$ and after the time $T_3$, determining whether the second sensor detects a second characteristic, and validating the shock tube event if the second sensor has sensed such second characteristic.

11. A method of operating a detonator according to claim 10 wherein such chosen time is time $T_1$ and said reference characteristic is the second characteristic.

12. A method of operating a detonator according to claim 10 wherein the first characteristic is a light signal associated with a genuine shock tube event.

13. A method of operating a detonator according to claim 10 wherein the first sensor is a light sensor.

14. A method of operating a detonator according to claim 10 wherein the second characteristic is a pressure wave which is associated with the shock tube event.

15. A method of operating a detonator according to claim 14 wherein the second sensor is a fusible link which, in response to the pressure wave, is fused.

16. A method of operating a detonator according to claim 14 wherein the second sensor is a plasma sensor which is responsive to a shock tube event.

* * * * *